US008875324B2

(12) United States Patent
Borgione

(10) Patent No.: US 8,875,324 B2
(45) Date of Patent: Nov. 4, 2014

(54) DISPLAY SYSTEMS FOR A MATTRESS

(75) Inventor: Marguerite L. Borgione, Summerfield, NC (US)

(73) Assignee: Sealy Technology, LLC, Trinity, NC (US)

( * ) Notice: Subject to any disclaimer, the term of this patent is extended or adjusted under 35 U.S.C. 154(b) by 224 days.

(21) Appl. No.: 13/007,056

(22) Filed: Jan. 14, 2011

(65) Prior Publication Data

US 2012/0180214 A1 Jul. 19, 2012

(51) Int. Cl.

| | |
|---|---|
| ***A47G 9/00*** | (2006.01) |
| ***G09F 23/06*** | (2006.01) |
| ***A47G 9/10*** | (2006.01) |
| ***A47G 9/02*** | (2006.01) |
| ***A47C 31/10*** | (2006.01) |
| *A47F 7/30* | (2006.01) |

(52) U.S. Cl.

CPC *G09F 23/06* (2013.01); *A47G 9/10* (2013.01); *A47G 9/0284* (2013.01); *A47F 7/30* (2013.01); *A47G 9/007* (2013.01); *A47C 31/105* (2013.01)

USPC ..... 5/485; 5/487; 5/490

(58) Field of Classification Search

USPC ..... 5/485, 487, 490, 501, 499, 639, 645, 5/482, 907, 650, 491, 492

See application file for complete search history.

(56) References Cited

U.S. PATENT DOCUMENTS

| | | | | |
|---|---|---|---|---|
| 5,548,858 | A * | 8/1996 | Shoa | 5/413 R |
| 5,898,962 | A * | 5/1999 | McNeal | 5/639 |
| 6,014,782 | A * | 1/2000 | Stevenson | 5/499 |
| 6,209,156 | B1 * | 4/2001 | Hershey | 5/490 |
| 6,216,292 | B1 * | 4/2001 | Oakhill et al. | 5/482 |
| 6,267,638 | B1 | 7/2001 | Connolly et al. | |
| 6,292,963 | B1 * | 9/2001 | Couture | 5/503.1 |
| 6,363,554 | B1 * | 4/2002 | Brown | 5/490 |
| 6,594,836 | B1 * | 7/2003 | Everson et al. | 5/485 |
| D482,923 | S | 12/2003 | Gaines | |
| 6,845,532 | B1 * | 1/2005 | Rosenblum | 5/482 |
| D504,269 | S | 4/2005 | Faircloth | |
| 7,089,617 | B1 | 8/2006 | Lauro | |
| 8,171,586 | B2 * | 5/2012 | Clack | 5/658 |
| 8,347,431 | B1 * | 1/2013 | Cohron, III | 5/490 |
| 2003/0126685 | A1 * | 7/2003 | Fryer | 5/655 |
| 2004/0016055 | A1 * | 1/2004 | Lamy | 5/485 |
| 2008/0086814 | A1 * | 4/2008 | Wootten | 5/499 |
| 2008/0289104 | A1 * | 11/2008 | Rowson et al. | 5/482 |
| 2010/0122413 | A1 * | 5/2010 | McNair | 5/485 |
| 2010/0154122 | A1 * | 6/2010 | Crispino et al. | 5/636 |
| 2011/0162139 | A1 * | 7/2011 | Grubb et al. | 5/499 |
| 2011/0179574 | A1 * | 7/2011 | Clack | 5/639 |
| 2012/0025998 | A1 * | 2/2012 | Wright et al. | 340/686.6 |

OTHER PUBLICATIONS

Amazon.com: DreamSacks Silk pocket Pillowcase—Honey: Kitchen and Dining, web page at http://www.amazon.com/DreamSacks-Silk-Pocket-Pillowcase-Honey/dp/B001A17Q9G, as available via the Internet and printed Oct. 20, 2010.

Hutchison Company, Mattress Display Holders, Foot Protectors POP Demos from HUTCHCO, web page at http://www.hutchco.com/site/HTML/mattress_pop_ad_display_sign_holder.html, as available via the Internet and printed Oct. 20, 2010.

* cited by examiner

*Primary Examiner* — Robert G Santos
*Assistant Examiner* — Richard G Davis

(57) ABSTRACT

Display systems for a mattress are described herein. The display systems can include a pocket configured to hold at least one pillow cover and a protective panel positioned on the top surface of a mattress. The protective panel can include an information display component.

6 Claims, 4 Drawing Sheets

DISPLAY SYSTEMS FOR A MATTRESS

FIELD OF INVENTION

The present invention relates generally to display systems for a mattress.

BACKGROUND

When purchasing a new mattress, a customer often wants to test the mattress in a showroom by laying on a sample mattress. Retailers and manufacturers often recommend that a customer fully test a mattress in a showroom to determine comfort, preference, style, and other features. Fully testing a mattress generally includes completely reclining upon a mattress to simulate the sleep experience.

Some customers may be reluctant to fully test a mattress for fear of getting the mattress dirty with shoes or placing their head on a pillow that was tested by another customer. These concerns may impact a customers' testing experience and interfere with the customer's evaluation of the product.

A variety of protective coverings have been placed upon a foot end of a mattress by retailers and manufacturers to protect a sample mattress from customer's shoes. Such coverings have been attached to mattresses in a variety of ways including providing apron-like extensions which extend over the foot end of the bed.

Thus, various embodiments of the present invention are directed at improving a customer's experience in evaluating mattresses by addressing such concerns and others.

SUMMARY

Described herein are various embodiments of a display system for a mattress. In some embodiments, a display system for a mattress having a top surface, a bottom surface opposite of and generally parallel to the top surface, and four side panels extending between and generally perpendicular to the top surface and bottom surface of the mattress, can include a pocket and a protective panel. The pocket can be configured to hold at least one pillow cover. The protective panel can be positioned on the top surface of the mattress and comprise an information display component.

Also described herein are some embodiments for protecting a pillow. In some embodiments, a system for protecting a pillow can include at least one pillow cover and a pocket configured to hold the at least one pillow cover. The pillow cover can be removed from the pocket and positioned upon the pillow for use by a customer. In some embodiments, a display mattress can include the system for protecting a pillow.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
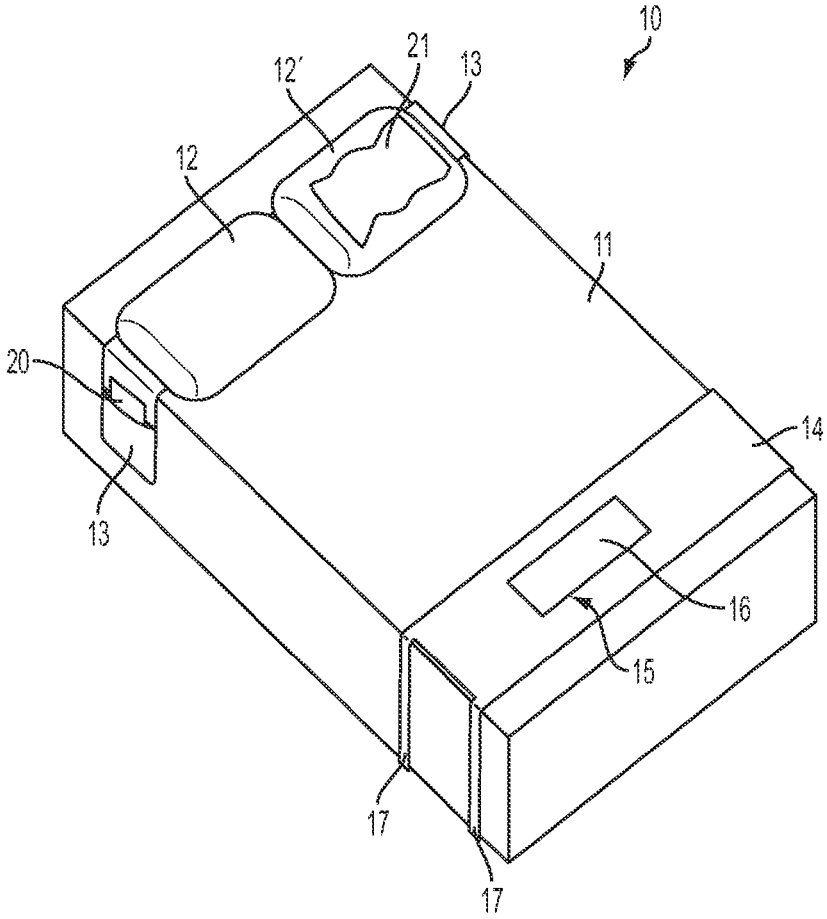
FIG. 1 is a perspective view of an illustrative embodiment of a display system for a mattress.

Certain aspects and embodiments described herein relate to systems and products that can be used in conjunction with a mattress to aid in a customer's shopping experience. In some embodiments, the display system for a mattress can improve the shopping or testing experience for the customer by providing a more inviting environment for the customer and by minimizing interferences with a customer's testing experience. In some embodiments, certain features of the mattress display system can also protect the mattress from excessive wear and dirt often experienced over time as numerous customers test the mattress. Certain features of the display system in some embodiments can also provide an increased area for the display of product information or other information.

Some embodiments described herein can be utilized on a mattress. In general, various embodiments of the present invention can be implemented on most any mattress including, without limitation, standard mattresses, pillow top mattresses, air mattresses, waterbeds, adjustable beds, innerspring mattresses, latex mattresses, and memory foam mattresses. In general, a mattress has a top surface and a bottom surface opposite of and generally parallel to the top surface. The mattress typically includes four side panels extending between and perpendicular to the top surface and bottom surface of the mattress.

Some embodiments of the present invention can be used in connection with a pillow. In general, such embodiments can be implemented in connection with most any pillow including, without limitation, foam pillows, pillows stuffed with synthetic down, pillows stuffed with feathers, or others. The term pillow as used herein also includes a pillow case or separate fabric cover which surrounds or encases the pillow. Thus, in embodiments described herein, unless otherwise specified, when the term "pillow" is used, it can refer to both the pillow component and the pillow case (when one is used). For example, certain features of the display system can be attached or affixed to the pillow component or the pillow case, though only the word pillow may be used in the below description.

In some embodiments, a display system for a mattress having a top surface, a bottom surface opposite of and generally parallel to the top surface, and four side panels extending between and generally perpendicular to the top surface and bottom surface of the mattress, can include a pocket and a protective panel. The pocket can be configured to hold at least one pillow cover. The protective panel can be positioned on the top surface of the mattress and comprise an information display component.

In some embodiments, the pocket can be positioned substantially parallel to one of the four side panels of the mattress. Generally, the pocket will be positioned in proximity to a head region of the mattress. In some embodiments, the pocket can be attached to a pillow positioned on the mattress. The pocket can be attached to the pillow by hook and loop fasteners, can be sewn to the pillow, or can be attached using other techniques. In other embodiments, the pocket can be attached to the mattress using similar techniques. The pocket, in some embodiments, can be positioned upon a strap located on one of the four side panels of the mattress. The pocket can be configured to hold a plurality of disposable pillow covers.

The protective panel is generally positioned at a foot end of the top surface of the mattress. In some embodiments, the information display component of the protective panel can comprise a plurality of panels for displaying information. The plurality of panels can include a hinged panel in some embodiments. In various embodiments, the information display component can display promotional material, marketing material, pricing information, and/or product specification material, as well as other information in any one or more of its panels or compartments. In some embodiments, the information display component can include an electronic device.

In some embodiments, the information display component can be sewn to or attached to the protective panel. In other embodiments, the information display component can be attached to the protective panel by hook and loop fasteners.

Also described herein are various systems for protecting a pillow. In some embodiments, the system for protecting a pillow can include at least one pillow cover and a pocket configured to hold the at least one pillow cover. The pillow cover can be removed from the pocket and positioned upon a pillow for use by a customer. In some embodiments, the pocket can be attached to the pillow. The pocket can be attached to the pillow by hook and loop fasteners, stitching, or other attachment devices. In other embodiments, the pocket can be configured to attach to a mattress. The pillow cover, in some embodiments, can be disposable. In some embodiments, a display mattress can include the system for protecting a pillow described herein.

In some embodiments, the display system can comprise a pocket configured to hold at least one disposable pillow cover. In certain embodiments, the pocket can be positioned along a side of a mattress, and often in proximity to the head end of the mattress. The pocket, in some embodiments, can be attached or affixed to the display mattress and/or the display pillow for keeping the position constant and for ease of retrieval.

The pocket can be a plurality of dimensions or shapes depending on a number of factors including, for example, the size and shape of the items to be held in the pocket. In embodiments of the present invention, the pocket is designed to hold a pillow cover such as a disposable pillow cover. In some embodiments, the pillow cover can be folded in multiple directions to reduce the size of the pillow cover. The pillow cover can be folded to a size which corresponds to the size and shape of the compartment defined by the pocket. Alternatively, the dimensions of the pocket can be selected to correspond to and be complementary to the shape of a pillow cover, in folded or unfolded form.

The pocket can be made of a fabric material in some embodiments. Typically, the pocket comprises a polygonal structure, and often a rectangular structure. In some embodiments, the pocket can be shaped like a diamond, a circle, a triangle, or other shape, either being symmetrical or asymmetrical. The pocket can comprise a size and shape sufficient to hold a plurality of pillow covers in some embodiments.

Often, a retailer or sale representative will encourage a customer to test a display mattress prior to purchasing a mattress. Some customers may be reluctant to fully test the mattress by lying down completely, and particularly resting his or her head upon a display pillow. Utilizing some embodiments of the present invention, a customer or sales representative can remove a pillow cover from a pocket connected to the pillow or the mattress, unfold the pillow cover (if needed), and place the pillow cover over a substantial portion of the pillow prior to the customer placing his or her head on the pillow. After the customer has finished testing the display mattress, the pillow cover can be disposed of or, in some cases, reused by the same customer on a different display mattress.

The pillow cover can provide a fresh surface upon which the customer can rest his or her head during evaluation of a mattress. In some embodiments, the pillow cover can comprise an anti-bacterial additive. In some embodiments, the pillow cover can be disposable or one-time use pillow cover. In other embodiments, the pillow cover can be a reusable pillow cover where a retailer or sales person may collect and wash the pillow cover for subsequent uses.

In some embodiments, the pillow cover can extend across the entire pillow. In other embodiments, the pillow cover can cover a large enough portion of the pillow for the customer to lay his or her head.

In some embodiments, the pocket can be attached to the pillow. In some such embodiments, the pocket can be attached to the pillow via hook and loop fasteners. In some embodiments, the hook and loop fasteners can be attached to the pocket via an adhesive, stitching, or integrally formed as a part of the pocket. The hook and loop fasteners can be applied to the pocket in a plurality of positions.

In one embodiment, the pocket can comprise a flap extending from a back panel of the pocket. The flap can provide additional surface area that can aid in the positioning of the pocket. In some embodiments, one portion of the hook and loop fastener can be applied to the flap portion of the pocket. The flap can be extended such that the flap contacts a pillow. A complementary portion of the hook and loop fastener can be positioned on the pillow. The two complimentary portions of the hook and loop fasteners can be aligned and connected to create a sufficiently secure connection. In some embodiments, such a connection can facilitates the positioning of the pocket such that the pocket does not inadvertently shift or move independently while being attached to the pillow.

In other embodiments, the flap comprising a hook and loop fastener may be sufficiently secured to the pillow comprising a sufficient tacky material, or strip of material, to create a sufficiently secure connection to prevent inadvertent shifting or moving of the pocket. In such embodiments comprising a sufficiently tacky material strip, the hook and loop fasteners can attach directly to the strip rather than requiring the complementary hook and loop fastener.

In other embodiments, the pocket may be sewn to the pillow. In such embodiments, the pocket can comprise a flap or extension of fabric to provide sufficient surface area or material for the stitching or sewing process. In other embodiments, the pocket may be attached to the pillow via an adhesive, button-type fasteners, clamps, clasps, or other connecting devices to create a sufficiently secure connection.

In yet other embodiments, the pocket can be attached to the side of a mattress according to the display systems described herein. In some embodiments, the pocket can be positioned about or around a horizontal strap of a mattress. For example, the pocket comprising a flap can include hook and loop fasteners. The flap can be positioned around the horizontal strap such that the portion of the flap having the hook and loop fastener component can be aligned with the complimentary hook and loop fastener component positioned on the back of the pocket. In other embodiments, the flap may comprise a weighted element providing sufficient frictional forces to minimize undesired movement of the pocket along the horizontal strap.

Generally, the pocket is positioned substantially parallel to a side of the mattress although other locations can be selected. Positioning of the pocket on the side of the mattress can be desirable in some embodiments as that location may minimize any interruption with the customer as he or she is testing the mattress.

In some embodiments, the display mattress system can comprise a protective cover panel. The protective cover panel can be positioned generally at the foot end of the mattress. The protective cover panel can provide a more durable surface upon which most customers' feet rest upon when testing the mattress. The protective panel can comprise a fabric material, vinyl, or other materials known to those of skill in the art.

In some embodiments, the protective panel spans from a first edge of the mattress to a second edge of the mattress. In some embodiments, the protective panel spans only across the top surface of the mattress. In other embodiments, the protective panel extends along the sides of the mattress in addition to spanning across the top surface of the mattress.

The protective panel can be secured to the mattress using techniques generally known to those of skill in the art. In some embodiments, the protective panel can comprise at least one strap to secure the protective panel around the mattress. In some embodiments, the protective panel comprises a plurality of straps extending from each edge of the protective panel. The straps can extend along the sides of the mattresses in a vertical direction to be tucked along the bottom surface of the mattress. Along the bottom surface of the mattress, the straps can be connected via complementary or mateable connectors. In some embodiments, the straps can comprise a molded plastic connector with a side release buckle configuration. The straps can include an adjustable device to facilitate the tightening of the straps around the mattress and in turn secure the position of the protective panel upon the mattress. In other embodiments, the straps may comprise an elastic material having sufficient tension to constrict about the mattress. Other straps and connecting devices can be utilized to position and secure the protective panel without departing from the spirit of the presently described invention.

In other embodiments, the protective panel can span the top surface of the mattress and extend down a first side and a second side of the mattress. Straps and connectors such as those described above may be utilized to position and secure the protective panel. In other embodiments, no straps or connectors may be utilized in the display system.

According to some embodiments of the present invention, the protective panel can include an information display component. In some embodiments, the protective panel can comprise a plurality of panels. Each panel can display information in some embodiments. For example, promotional materials, product information, company information, pricing information, and other informative material can be included within any one of the panels of the information display component. In some embodiments, the panels can include a compartment. The compartment can be positioned behind a transparent panel or window like structure. For example, the compartment can be formed by having an opening or slit on one side of the transparent panel such that information can be positioned and viewed behind the transparent panel.

In some embodiments, product specifications and literature can be included within the information display component including, for example information on construction of the mattress. In some embodiments, the information can be presented in a spiral bound book. The book can include, for example, product specification, descriptions, photographs, diagrams, and other information. In some embodiments, the book can include a plurality of pages comprising acetate overlays. In some embodiments having a book comprising acetate overlays, a manufacturer or retailer may provide information as to how the mattress is constructed. The pages of the book may include certain information on a portion of the mattress, for example, information as to the different layers of construction of a mattress. As the pages are overlaid upon, or peeled away from, one another, the respective portions of each page can be seen showing the interaction of each portion, or covered depending upon the information being shown. The pages of such a book can be at least partial transparent such that certain information of other pages can be visible.

In some embodiments, the information display component can comprise an electronic device. The electronic device can be an audio or visual output device in some embodiments. For example, a display monitor or computer tablet such as an iPad® can be positioned within the information display component in some embodiments. The electronic device can, for example, display promotional videos, slide shows, or other materials. The electronic device can be battery powered, AC powered, or a combination of both.

In some embodiments, the information display component can comprise a hinged panel that allows the opening and closing of the information display component. In such embodiments, the information display component can present information without interrupting a customer's testing of a mattress. In the closed position, the information display component can rest substantially flat or flush with the protective panel. In the closed position, certain information on a first panel or second panel can be concealed from the consumer. Often, the closed position can invite the customer to further explore the information within the information display component.

Features of some embodiments described herein can provide systems and components to assist the customer in testing and evaluating a mattress prior to purchase or ordering. Features of the systems described herein can provide a more inviting experience for the full testing of a product by minimizing interferences with a customer's testing of the mattress.

Referring to the Figures, the numbers used within each figure are consistent with every other figure. When a specific feature is labeled in one figure with a specific numeral, the same numeral will be used in other figures when denoting that specific feature.

FIG. 1 shows a top perspective view of a system 10 for displaying a mattress. The system 10 includes a mattress 11, a pillow 12, a pillow 12', and a protective panel 14. A pocket 13 is attached to the pillow 12. In other embodiments (for example, as shown in FIG. 3), the pocket 13 can be unattached from the pillow 12. The pocket 13 can provide a structure to hold or contain at least one pillow cover 20. The pillow cover 20 can be folded such that the pillow cover 20 can fit in the pocket 13. The pocket 13 may comprise a size sufficient to contain a plurality of pillow covers 20. As a customer tests a mattress, the customer or sales representative can remove a pillow cover 20 from the pocket 13, unfold the pillow cover 20, and place the pillow cover 20 on the pillow 12 to substantially cover a portion of the pillow 12 upon which a customer's head may rest. An unfolded pillow cover 21 is shown laid upon the pillow 12'.

Also shown in FIG. 1 is the protective panel 14 having an information display component 15. The information display component 15 includes a top display panel 16. In some embodiments, product identification information, logos, trademarks, mattress lines, and other information can be incorporated into the top display panel 16. The protective panel 14 includes straps 17 which are shown extending down the side of the mattress 11.

Figure 2:
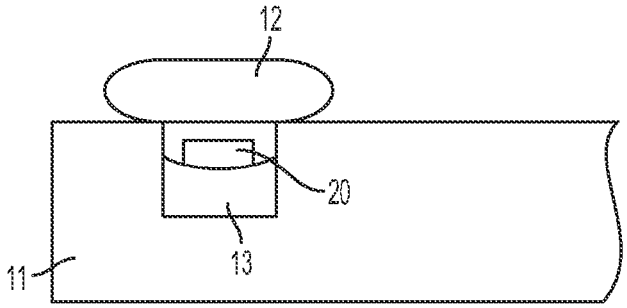
FIG. 2 is a side elevational view of an illustrative embodiment of a pocket containing a pillow cover.

FIG. 2 shows a side view of a portion of the system 10. The pocket 13 is affixed to the pillow 12. The pocket 13 hangs off of the pillow 12 along the side of the mattress 11. In the embodiment shown in FIG. 2, the pocket 13 is sewn to a pillowcase of the pillow 12. In other embodiments, the pocket 13 can be attached to the pillowcase of the pillow 12 by hook-and-loop fasteners, buttons, pins, clasps, and other fastening devices known to those of ordinary skill in the art.

Figure 3A:
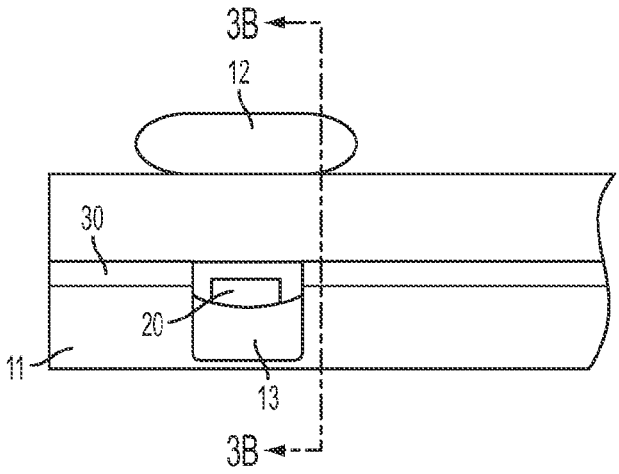
FIG. 3A is a side elevational view of another illustrative embodiment of a pocket containing a pillow cover.
Figure 3B:
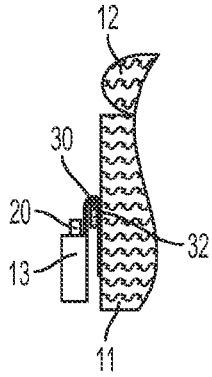
FIG. 3B is cross sectional view of the pocket containing a pillow cover shown in FIG. 3A along plane 3B.

FIG. 3A shows a side view of a portion of the display mattress system 10 with an alternate placement of the pocket 13. The pocket 13 is attached to a horizontally oriented strap 30 along the side of the mattress 11. The pocket 13 can comprise a flap 32 (shown in FIG. 3B) that removably secures the pocket 13 in the position around the horizontal strap 30 on the side of the mattress 11. FIG. 3B is a cross sectional view along the plane 3B of FIG. 3A showing the flap 32 draped or folded over the horizontal strap 30. In some embodiments, space between the horizontal strap 30 and the mattress 11 may be sufficiently small to create such that the flap is anchored between the strap 30 and the mattress. In other embodiments, a hook and loop fastener can be applied to the flap 32 such that a sufficiently secured connection is formed to prevent any undesired movement of the pocket 13. In yet other embodiments, the flap 32 can comprise a weighted element in either or both of the flap 32 and pocket 13 to decrease the likelihood of any undesired movement of the pocket 13 along the side of the mattress 11.

Figure 4:
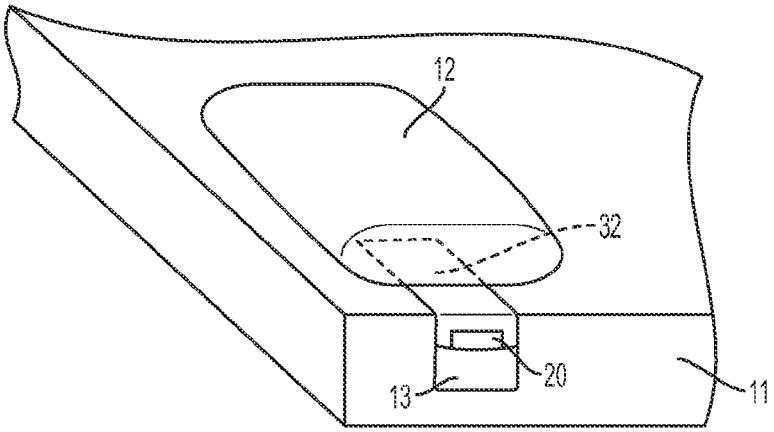
FIG. 4 is a perspective view of an illustrative embodiment of a pocket containing a pillow cover.

FIG. 4 shows a perspective view of a portion of the system 10 with a pocket 13. The pocket 13 comprises a flap 32 which extends under the pillow 12. The flap 32 can provide sufficient surface area such that the weight of the pillow 12, coupled with any frictional forces between the pillow 12 and flap 32, can anchor the pocket in its position along the side of the mattress 11. In some embodiments, the flap 32 can include a portion of hook and loop fastener. In some embodiments, complementary hook and loop fasteners can be affixed to both the pillow 12 and the flap 32. In other embodiments, a hook and loop fastener can be applied to the flap 32 and sufficiently tacky fabric, capable of providing a mateable surface to the hook and loop fasteners, can be applied to the pillow 12. In yet other embodiments, the flap 32 can comprise a weighted element to aid in the positioning of the pocket 13.

Figure 5:
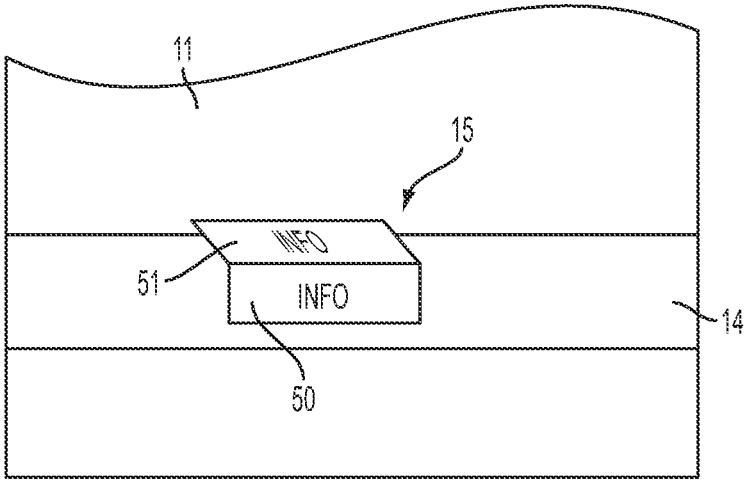
FIG. 5 is a top view of an illustrative embodiment of a protector panel comprising an information display component.

FIG. 5 shows a top view of a portion of the system 10 comprising the protective panel 14 having the information display component 15. The information display component 15 is shown in the open position in FIG. 5. A first display panel 50 and a second display panel 51 are viewable when the information display component 15 is in the open position. When the information display component 15 is in the closed position, the top display panel 16 is viewable (as shown in FIG. 1). In some embodiments, an electronic device can be positioned on the first display panel 50.

Figure 6:
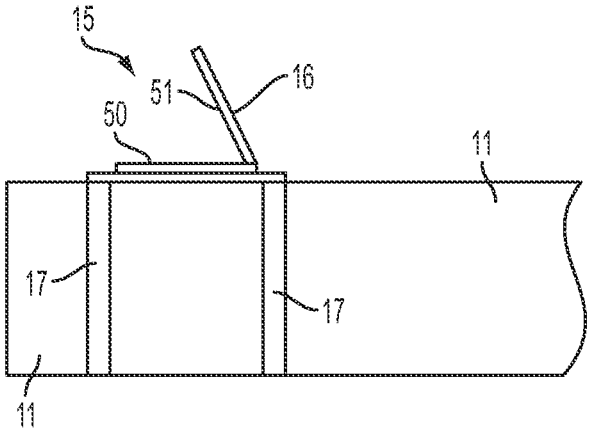
FIG. 6 is a side view of an illustrative embodiment of a protector panel comprising an information display component.

FIG. 6 shows a side view of the protective panel 14 with the information display component 15 in an open position. The information display component 15 is positioned on top of the protective panel 14. The information display component 15 can be attached to the protective panel 14, for example by using hook-and-loop fasteners. In such embodiments, the information display component 15 can be removed and/or interchanged with minimal effect upon the protective panel 14. In other embodiments, the information display component 15 can be sewn to the protective panel 14 or formed directly into the protective panel 14. In yet other embodiments, the information display component can be attached to the protective cover panel by buttons, pins, clasps, and other fastening devices known to those of ordinary skill in the art. The protective panel 14 has straps 17 extending from a outer edge of the protective panel 14 along the side of the mattress 11. The straps 17 extend underneath the mattress 11. The straps 17 comprise a molded plastic connector (not shown) with a side release buckle configuration on the end of the strap.

Figure 7:
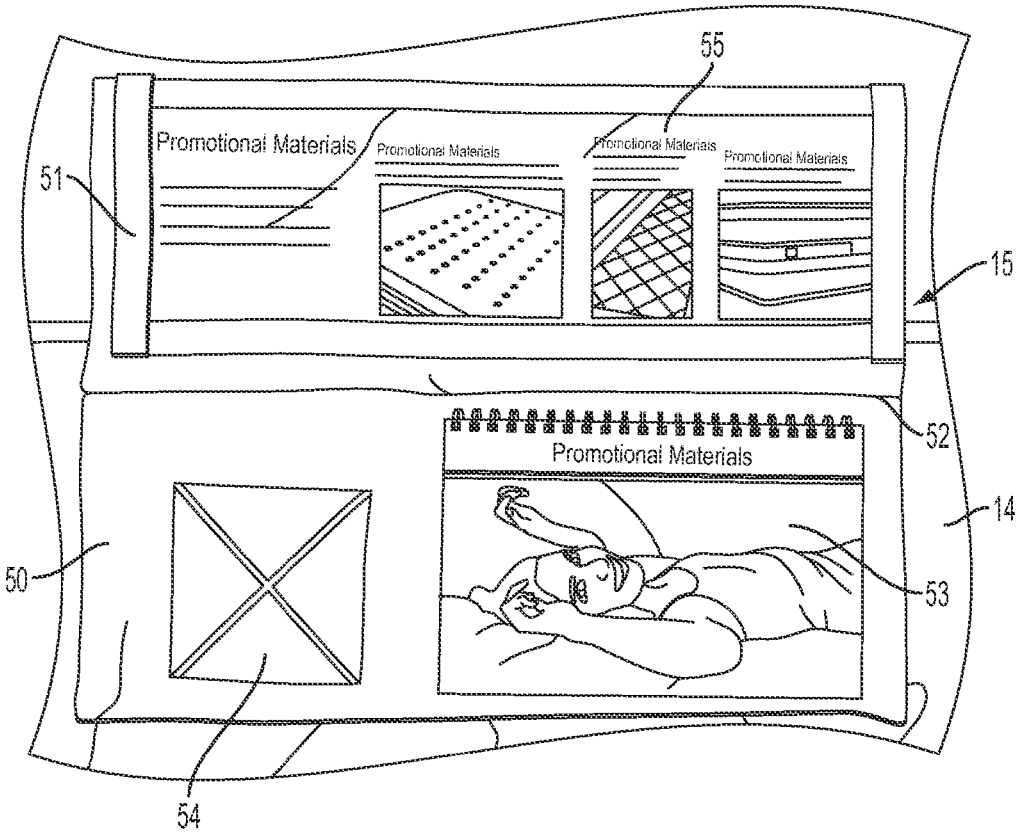
FIG. 7 is a top view of an illustrative information display component.

FIG. 7 shows a top view of the information display component 15. The information display component has the first display panel 50 and the second display panel 51. The information display component 15 shown includes a hinged portion 52 such that the information display component 15 can be opened and closed. The first panel 50 includes a window 54 and a acetate overlay notebook 53. The second panel 51 includes a window 55. Promotional material is shown inserted behind the window 55.

The foregoing description of the embodiments, including illustrated embodiments, of the systems and products have been presented for the purpose of illustration and description and is not intended to be exhaustive or to limit the invention to the precise systems or forms disclosed. Numerous modifications, adaptations, and uses thereof will be apparent to those skilled in the art without departing from the scope of the description herein.

What is claimed is:

1. A system for protecting a pillow resting on a mattress and having a pillow case, the system comprising:

at least one pillow cover; and a pocket configured to hold the at least one pillow cover wherein the pillow cover can be removed from the pocket and positioned upon a pillow for use by a customer, the pocket attached to the pillow case, and having an upright portion adjacent a sidewall of the mattress and having a lay-flat portion connected to an upper end of the upright portion and adjacent a top surface of the mattress, and wherein the lay-flat portion is configured to be partially hidden by the pillow when the pillow to receive the at least one pillow cover is laying on the top surface of the mattress adjacent the sidewall of the mattress.

2. The system of claim 1, wherein the pocket is releasably attached to the pillow case.

3. The system of claim 2, wherein the pocket is releasably attached to the pillow case with hook and loop fasteners.

4. The system of claim 2, wherein the pocket is sewn to the pillow case.

5. The system of claim 1, wherein the at least one pillow cover is disposable.

6. A display mattress comprising the system for protecting a pillow of claim 1.

* * * * *